United States Patent [19]

Berg et al.

[11] 3,975,151

[45] Aug. 17, 1976

[54] CLOTH RESERVE DYEING

[75] Inventors: Betsy Helen Berg, London; Susana S. Szabo, Richmond, both of England

[73] Assignee: BSG Designs Inc., London, England

[22] Filed: Aug. 13, 1973

[21] Appl. No.: 387,772

[52] U.S. Cl. ..... 8/14; 8/25; 8/62; 8/148; 68/211

[51] Int. Cl.[2] ..... D06P 7/00

[58] Field of Search ..... 8/14, 25, 62, 148; 68/211

[56] References Cited

UNITED STATES PATENTS

| | | | |
|---|---|---|---|
| 1,461,822 | 7/1923 | Epstein | 68/211 |
| 1,557,461 | 10/1925 | Lauten | 8/14 |
| 1,655,973 | 1/1928 | Ross | 8/14 |
| 2,107,536 | 2/1938 | James et al. | 68/211 |
| 2,273,305 | 2/1942 | Whitehead | 8/14 |
| 3,368,864 | 2/1968 | Gugerli | 8/25 |
| 3,644,969 | 2/1972 | Guillermin et al. | 8/148 |

OTHER PUBLICATIONS

Redbook, vol. 135, No. 2, June 1970, pp. 81, 172, 174 & 176.

*Primary Examiner*—Ronald W. Griffin
*Attorney, Agent, or Firm*—Larson, Taylor and Hinds

[57] ABSTRACT

A method for dyeing fabric to give pattern comprises clamping the fabric in certain configurations such as a folded configuration and applying dyestuffs which diffuse differentially between the clamps.

8 Claims, 7 Drawing Figures

CLOTH RESERVE DYEING

Figures 1, 2, 3:
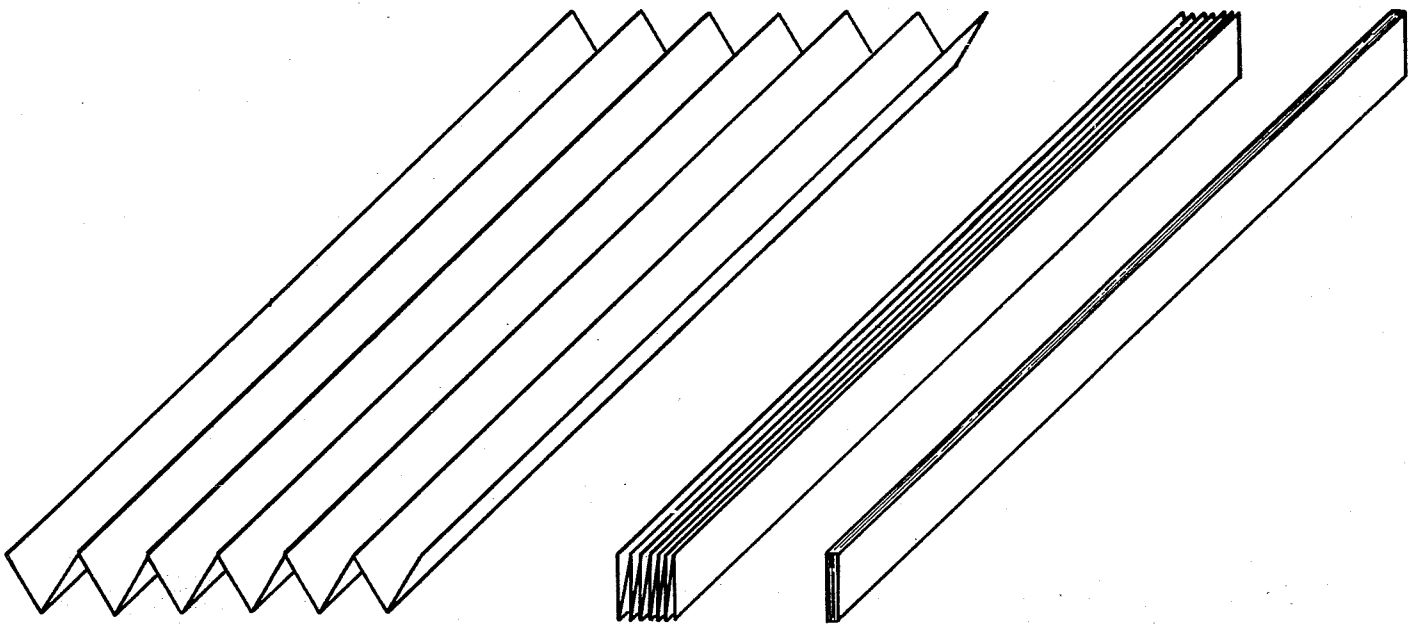

The invention relates to methods for dyeing fabrics in patterns for use in making fabrics with novel decorative effects.

It is an object of the invention to provide a method for colouring fabric giving an attractive pattern visible from both sides of the fabric by a relatively simple technique.

The invention provides a method of pattern dyeing which comprises clamping a fabric in a particular configuration and contacting the clamped fabric with one or more dye-baths containing at least two different dyestuffs, the clamped fabric then being treated so that the dyestuffs diffuse differentially into the clamped fabric and are fixed in the differentially diffused condition. Preferably the fabric is clamped in a particular pleated and/or folded configuration. Conveniently the fabric is clamped between plates modified to influence the diffusion of the dyestuffs. A single dye-bath may be used containing at least two different dyestuffs or a succession of two or more dye-baths may be used each dye-bath containing at least one dyestuff. Good effects may be obtained on certain materials such as silk where the dye-bath contains reactive dyestuff. Preferably the dye-bath or dye-baths comprise a thickened solution of dyestuff into which the clamped fabric is dipped.

The diffusion process and fixing of dyes may be influenced by the clamping pressure, composition of dye-bath or temperature. The fixing of the dyestuffs may be effected in a separate process step but it may also be effected during the same process step which is used to effect differential diffusion of the dyestuffs.

If a dyestuff needs to be fixed separately, this should be done before the fabric is unclamped, or at least before the dye-stuffs have migrated into the fabric to the same extent. The fabric may be contacted with one or more other dye-baths before or after the application of the method of the invention. The clamping pressure may be altered during the contacting of the fabric with the dye-bath or during fixing to vary the effect obtained. The fabric may be wet prior to clamping or treated with a chemical agent to influence the extent of migration of any dyestuff or dyestuffs.

The clamping configuration may be determined by the shape of the faces of the clamp used and/or any working perforation grooving or engraving, for example, thereon. The clamp used should not react to any substantial extent with the dye or fixing bath. Thus the clamp may be made of stainless steel or of chromium-coated copper, for example. The clamp is preferably such that the clamping pressure can be adjusted to a predetermined value, so as to give reproducible results. Several layers of fabric can be treated at one time to give a repeated pattern, whether on a single folded or pleated sheet or on a number of sheets.

On clamping the textile fabric into folds or on clamping a single or a number of fabrics together, a pocket or patch of the fabric becomes not directly accessible to the dye-bath. The dyestuff in the dye-bath can only reach the clamped or folded areas by penetrating the fabric in an accessible part of the fabric and migrating into the area or pocket where dye-access is limited. The ability of different dyestuffs to move into the non-accessible area can be significantly different under appropriate conditions of clamping pressure, fabric and fibre composition, temperature and dyestuff selection.

In this way fabrics can be prepared which are in one patch dyed by all dyestuffs in the bath and in parts marginal to the patch predominantly by one or more selected dyestuffs present in the bath. The word dyestuff is used herein to indicate a compound of a particular molecular configuration. In commerce the word dyestuff is used to indicate a particular type of dye which often are mixtures of dyestuffs of different molecular configuration. Such commercial mixtures may have components which migrate into the fabric to different extents by the method of the invention.

The method of this invention may be made cntinuous by using a clamping belt and passing a length of fabric through clamping, dyeing, fixing (if necessary), and unclamping stations. Dye-bath and like additives may be introduced where appropriate and desired.

This invention is applicable to natural or synthetic or mixed fabrics, for example cotton, silk, polyester or polyamide fabrics. Natural and/or synthetic dyestuffs may be used.

The method where folded fabric is used can be referred to as clamped folded fabric dyeing or, briefly, CFFD. In CFFD specially shaped plates and clamps are employed to block the dye and to exploit the differential availability of the dyestuffs applied in the blocked parts or on the margins thereof. In CFFD the fabric may be precisely pleated and folded to produce packages of fabric which are then placed between shaped plates and held tightly between clamps throughout the dyeing operation. Multicoloured patterns can be produced without removing the packages from the clamps. CFFD gives fully penetrated dyeings so that the patterns are equally visible on both sides of the fabric. In CFFD the preparatory work on the fabric is limited to pleating and folding and the attachment of the plates by clamping. In CFFD specific lengths of the fabric to be decorated may be converted into compact blocks or packages of fabric. The type of pleating and folding used determines the basic geometry of the decorative pattern which will be finally produced on the fabric. Simple cube shaped or oblong packages may be produced from fabrics which have been pleated and folded using parallel pleats and parallel folds. The word pleat is used to describe the primary accordian folding of a fabric on itself to make bands of multiple thickness. The word fold is used to describe the operation of folding the pleated bands to produce the basic pattern forms and to build up at the same time the block or package of material. More complex packages may be obtained by folding pleated fabrics at angles other than 90°. The pleating and folding can be done by hand with the aid of a table and iron.

The clamp plates are preferably applied, one to the top and one diametrically opposite, to the package in which the layers of pleated and folded fabric lie in a horizontal plane and the pleat edges outside of the folds form the sides lying in vertical planes.

The clamp may be a G shaped or H-shaped clamp. The clamp plates may be chromium plated steel and for in example a circular disc, cruciform, oblong, equilateral or right angled triangular form.

The pattern style and colouring is also strongly influenced by the technique of applying the dye liquors and by the differential fixation of dyes of different type but of the same class when one or more of each type are applied from the same dye-bath. Thus in reactive dyestuffs there are different types of products with varying migration properties. With cyanuric-chloride reactive dyes a first type is known as a dichloro-triazine group of dyes and the other as a monochloro-triazine group of dyes. The former group consists of dyes which are highly reactive and that combine, particularly with cellulosic fibres, under suitable conditions, much more quickly than the latter type. Advantage is taken of this difference in properties in CFFD in that when a dye liquor consisting of a mixture of monochloro and dichloro-triazines is applied from a cold dye-bath rapid fixation of the dichloro type dyestuff takes place, whereas, the monochloro derivative remains in solution and unfixed. Depending upon the conditions, the unfixed dye remains free to move about and to undergo further diffusion in the fibre being dyed. Thus if an area of a fabric has been dyed with the dichloro dye and portions of the fabric are left uncloured, the unfixed monochloro dye left free will, under suitable conditions, migrate into the undyed fabric and can be there fixed by modification of the fixation conditions. It is, therefore, possible to produce multicoloured patterns from mixtures of dyes in the same dye-bath when applied to a substrate consisting of one type of fibre as well as on substrates constructed from different types of fibres.

Differential diffusion of dyes of the same class and type is also possible sometimes and may be used as a means for the production of multicoloured effect patterns from the same dye-bath in CFFD.

The invention is more particularly described with reference to the drawings in which:

FIGS. 1 to 7 show successive steps in the preparation of the fabric for dyeing.

STAGE 1 (FIGS. 1 to 5)

Figure 4:
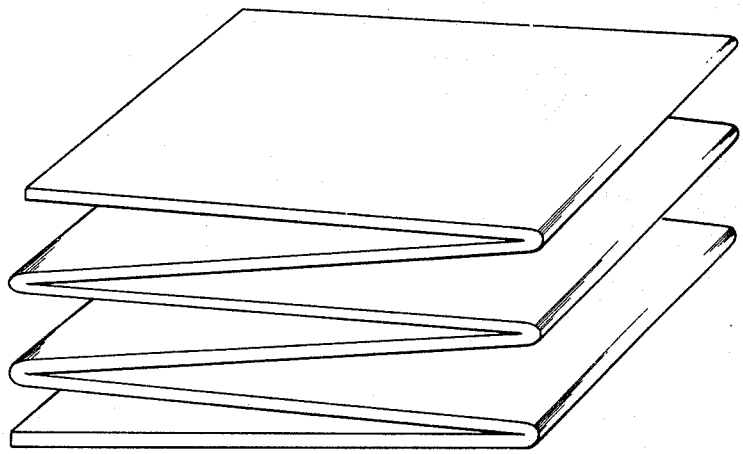
Figure 5:
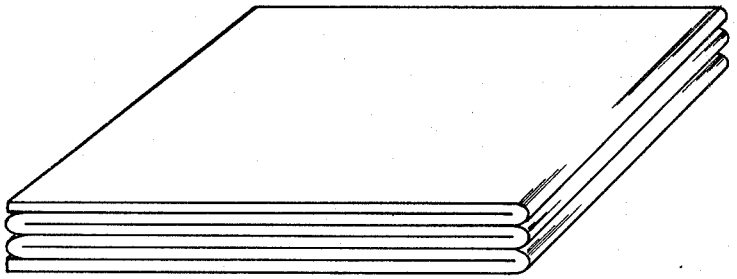
Figure 6:
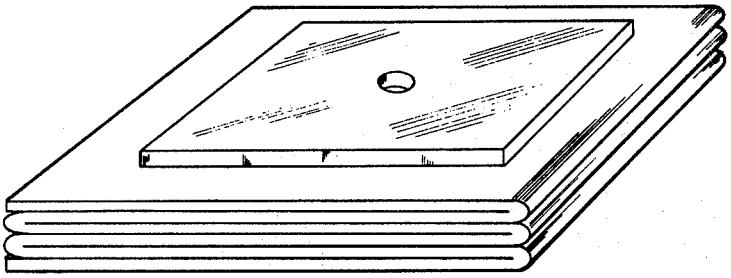

A length of fabric to be decorated is pleated transversely (FIG. 1) and packed (FIG. 2) to form a strip of fabric (FIG. 3). The strip is folded into a package the shape of which can be determined by the pleating and folding dimensions and style. The strip is folded accordionwise into a compact package (FIGS. 4 and 5).

STAGE 2

Figure 7:
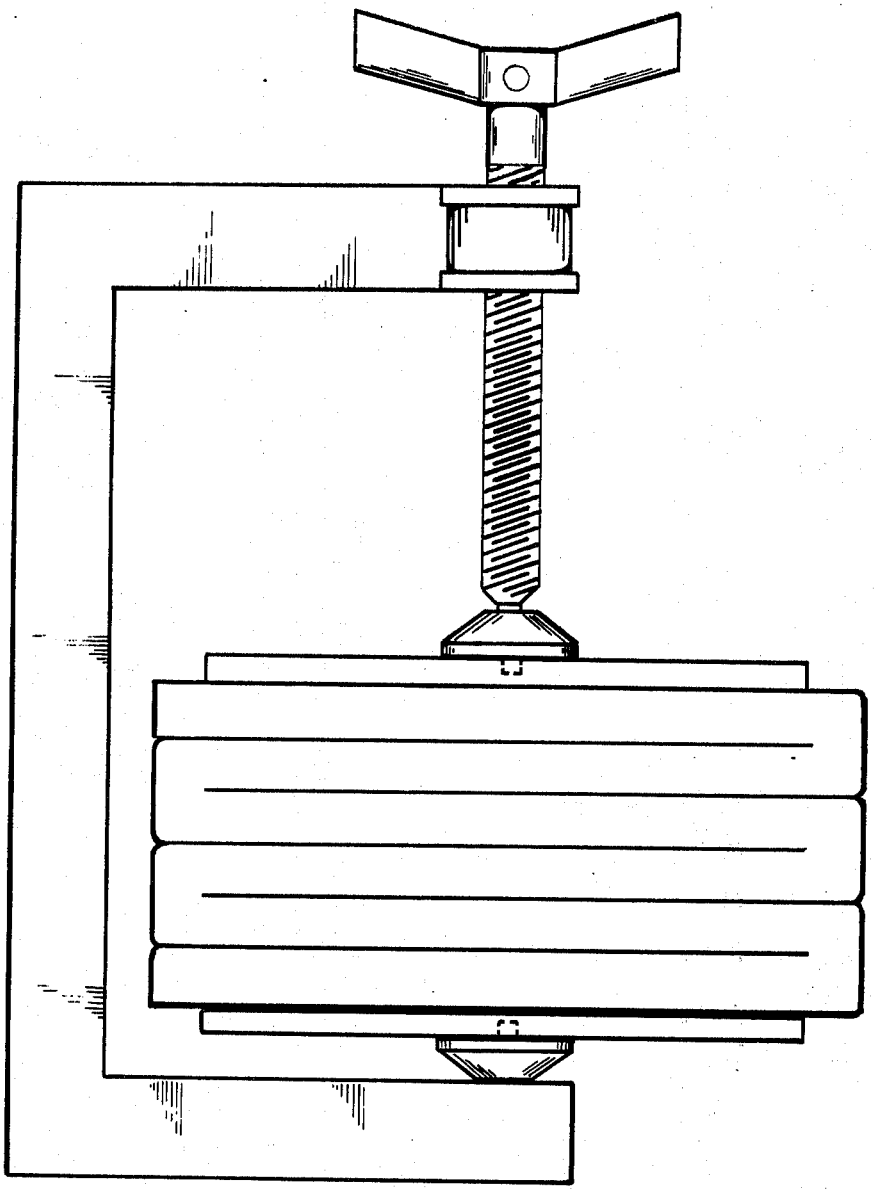

The shaped pressure plates are then place in position above and below the package (FIG. 6) and is then clamped tightly between the jaws of a specially designed or modified clamp with jaws which allow of the rotation of the package around an axis between the jaw centres (FIG. 7).

STAGE 3

The dye is applied to the clamped package by lowering a portion of the package into a dye-bath and allowing a quantity of dye liquor to be absorbed by the package. The amount of dye liquor taken up is estimated either by the volume of the bath or by the period of contact of the package with the bath. Alternatively a specific volume of dye liquor can be applied by controlled direction of a quantity of dye liquor to the package. Complete immersion of the package in a dye-bath of sufficient volume may also be practiced. Multicoloured dyeings from dye liquors containing mixtures of different dyes can be obtained.

The invention is further illustrated by the Examples in which all parts are by weight.

The dyes used in the Examples have been identified by their index numbers in "The Colour Index" published by The Society of Dyers and Colourists and The American Association of Textile Chemists and Colourists.

EXAMPLE 1

A silk square, is pleated and folded into a package based on 3 in. thickness of accordion pleats and folds and clamped between 2 circular stainless steel discs each of 2½ inch diameter. The package is suspended over a small shallow dye-bath.

Three different dye solutions were prepared according to the following recipes.

| | | |
|---|---|---|
| Dark Green. | | |
| Procion Olive MX-3G (CI Reactive Green 6) | 12.5 | parts |
| Procion Blue MX-R (CI Reactive Blue 4) | 12.5 | " |
| sodium alginate | 3.75 | " |
| Calgon PT | 0.94 | " |
| urea | 75.00 | " |
| soda ash | 25.00 | " |
| water to bulk to | 1000.00 | " |
| Note: Procion and Calgon are registered Trade Marks. | | |
| Light Green. | | |
| Procion Turquoise H-A (CI Reactive Blue 71) | 6.25 | parts |
| Procion Blue H-B (CI Reactive Blue 2) | 6.25 | " |
| Procion Brown H-BD (CI Reactive Brown 8) | 6.25 | " |
| Procion Yellow MX-R (CI Reactive Yellow 4) | 6.25 | " |
| sodium alginate | 3.75 | " |
| Calgon PT | 0.94 | " |
| urea | 75.00 | " |
| soda ash | 25.00 | " |
| water to bulk to | 1000.00 | " |
| Brown. | | |
| Procion Orange Brown H-G (CI Reactive Brown 1) | 16.60 | parts |
| sodium alginate | 3.33 | " |
| Calgon PT | 0.83 | " |
| urea | 100.00 | " |
| soda ash | 30.00 | " |
| water to bulk to | 1000.00 | " |
| All the solutions were at room temperature 20°C. | | |

The soda ash was added to each dye solution just prior to application to the fabric package. The dyes were applied to the dry silk package from dye-baths each containing 40 mls of one dye solution, by dipping a corner of the clamped package into the dye-bath until the dye was absorbed, then the package was lifted and another dye-bath with a different solution was placed under the package. The package was then rotated so that the next undyed corner was brought into position for lowering into the bath and so on until all four corners had been allowed to absorb the dyes from the separate dye-baths. The first corner of the package was dippped in the Brown solution, the second corner in the light Green solution, the third corner in the Brown solution and finally the fourth corner in the Dark Green solution. The dyed packages were allowed to stand at room temperature for 1 hour and then fixation of the dyes was completed by heating the packages in a stove at 80°C. for 2 hours. Finally the fabric was removed from the clamp and washed in soap solution to remove any unfixed dye.

EXAMPLE 2

The silk square in the form of a rectangular package as in Example 1 was clamped between 2 inch square plates. The sides of the plates were set on the package so that each corner of the package formed a triangular portion of exposed fabric protruding from between the two plates. Two dye solutions were prepared according to the following recipes.

| | | |
|---|---|---|
| Light Green. | | |
| Procion Blue MX-R (CI Reactive Blue 4) | 5.60 | parts |
| Procion Yellow MX-GR (CI Reactive Yellow 7) | 3.75 | " |
| sodium alginate | 1.75 | " |
| Calgon PT | 0.44 | " |
| urea | 100.00 | " |
| soda ash | 15.00 | " |
| water to bulk to | 1000.00 | " |
| Dark Green. | | |
| Procion Blue MX-R (CI Reactive Blue 4) | 22.40 | " |
| Procion Yellow MX-GR (CI Reactive Yellow 7) | 15.00 | " |
| sodium alginate | 1.75 | " |
| Calgon PT | 0.44 | " |
| urea | 100.00 | " |
| soda ash | 15.00 | " |
| water to bulk to | 1000.00 | " |

The solutions were kept at room temperature 20°C. The soda ash was added to each dye solution just prior to application to the fabric package. The dyes were applied to the dry silk package from dye-baths each containing 32 mls of dye solution, by dipping a corner of the clamped package into the dye-bath until the dye was absorbed. The package was then lifted, the dye-bath recharged with dye liquor of the same composition and then the package was turned through 180° to bring the corner opposite to the dyed corner over the dye-bath. The package was then lowered to allow the corner into the dye-bath. When the dye was absorbed the package was lifted. The two undyed corners were then dyed in a similar way but with the second solution (Dark Green). The dyed packages were allowed to stand at room temperature for 1 hour and then fixation of the dyes was completed by heating the package in the stove for 2 hours at 80°C. Finally, the fabric was removed from the clamp and washed in soap solution to remove any unfixed dye.

We claim:

1. Method of pattern dyeing which comprises folding a fabric and forming a succession of fabric areas lying side by side; clamping the folded fabric to urge adjacent areas together and form a compact block of the fabric to restrict dyestuff access to parts of the areas internally of the block and leave parts of the areas towards the exterior of the block accessible to the dyestuff; applying at least one dye liquor and thereby at least two different dyestuffs to the exterior of the block, one dyestuff having a faster speed of diffusion between the said parts of the areas to which dyestuff access is restricted than the other dyestuff, and next treating the block to diffuse the one dyestuff from the exterior of the block into the parts of to the areas of restricted dyestuff access and leave the other dyestuff substantially on parts of the areas accessible to dyestuff and separate the one dyestuff at least partly from the other dyestuff in each of the areas lying side by side.

2. Method as claimed in claim 1 wherein the fabric is folded to give pleats and a strip of superimposed fabric layers and then folded at an angle to the pleats.

3. Method as claimed in claim 1 wherein said dyestuffs are applied from at least two separate dyetuff solutions each containing at least one dyestuff.

4. Method as claimed in claim 1 wherein said dyestuffs are applied from a single dyestuff solution.

5. Method as claimed in claim 1 in which the dyestuffs are applied at a plurality of external locations of the clamped folded fabric.

6. Method as claimed in claim 1 wherein the dyestuffs are applied from aqueous solution containing a thickening agent.

7. Method as claimed in claim 1 wherein the said one dyestuff is a reactive dyestuff having two reactive groups and said other dyestuff is a reactive dyestuff having one reactive group.

8. Method as claimed in claim 7 wherein the said reactive dyestuffs are fixed in a separate fixation treatment.

* * * * *